US011079192B2

(12) United States Patent
Corso

(10) Patent No.: US 11,079,192 B2
(45) Date of Patent: Aug. 3, 2021

(54) COMPACT FLAT MAGAZINE SPRING

(71) Applicant: Steven Corso, Cody, WY (US)

(72) Inventor: Steven Corso, Cody, WY (US)

( * ) Notice: Subject to any disclaimer, the term of this patent is extended or adjusted under 35 U.S.C. 154(b) by 0 days.

(21) Appl. No.: 16/895,893

(22) Filed: Jun. 8, 2020

(65) Prior Publication Data

US 2020/0386497 A1 Dec. 10, 2020

Related U.S. Application Data

(60) Provisional application No. 62/857,989, filed on Jun. 6, 2019.

(51) Int. Cl.
*F41A 9/65* (2006.01)

(52) U.S. Cl.
CPC ..... *F41A 9/65* (2013.01)

(58) Field of Classification Search
CPC ..... F41A 9/65
See application file for complete search history.

(56) References Cited

U.S. PATENT DOCUMENTS 254,453 A * 3/1882 Borchardt ..... F41A 9/65 42/50
283,122 A * 8/1883 Lewis ..... F41A 9/65 42/50
3,039,221 A * 6/1962 Musgrave ..... F41A 9/70 42/50
3,964,199 A * 6/1976 Musgrave ..... F16F 1/22 42/50
4,205,474 A * 6/1980 Musgrave ..... F16F 1/02 267/165
4,252,302 A * 2/1981 Musgrave ..... F16F 1/18 267/165
4,397,453 A * 8/1983 Seecamp ..... F41A 9/70 267/166.1
5,664,355 A * 9/1997 Ronkainen ..... F41A 9/65 42/18
9,506,706 B2 * 11/2016 Higley ..... F41A 9/70
2018/0094886 A1 * 4/2018 Corso ..... F41A 9/70

OTHER PUBLICATIONS

"Glock 43 Magguts", Mar. 3, 2019, https://magguts.com/product/glock-43/ (Year: 2019).*

* cited by examiner

*Primary Examiner* — Joshua T Semick
(74) *Attorney, Agent, or Firm* — Malloy & Malloy, P.L.; Robert M. Downey

(57) ABSTRACT

A flat spring for firearm magazines has a one-piece unitary body with end half-coils at opposite ends and interior coils in a repeating arrangement between the end half-coils. Each of the interior coils includes an upper half-coil and a lower half-coil, each extending between outer tips on opposite sides of the spring body. Increasing and staggering the half-coil lengths, adjusting the radii of the outer tips and shaped matching the end half-coils and upper and lower half-coils within the magazine housing all contribute to a flat magazine spring that uses all available space within a firearm magazine to effectively reduce the number of coils and material thickness so that the compressed spring height is at its absolute minimum, thereby allowing for maximum space for ammunition.

19 Claims, 4 Drawing Sheets

COMPACT FLAT MAGAZINE SPRING

BACKGROUND OF THE INVENTION

This non-provisional patent application is based on provisional patent application Ser. No. 62/857,989 filed on Jun. 6, 2019.

FIELD OF THE INVENTION

The present invention relates to a magazine spring as used in automatic and semiautomatic pistols and rifles, and more particularly an improved one-piece magazine spring that allows additional space for bullet storage by requiring less space for the compressed spring, thereby accomplishing a more compact design.

DISCUSSION OF THE RELATED ART

Typical magazines for firearms contain a single oval spring wound from round wire. Because of the length and force required from the spring, a conical style cannot be used. When compressed, the coils (i.e., winds) of the spring stack upon one another. In a typical wire magazine spring, much of the space available for the spring is wasted as the spring is formed in the shape of an oval and contains a large unused area in its center. This makes for a very inefficient design as it relates to utilizing the space within the magazine. While far less common, there have also been magazine springs made of a flat strip material that is formed into an accordion shape. This type of spring has also suffered from inefficient use of the available space within the magazine housing.

Firearm magazines come in many different sizes, shapes, and configurations. For example, the follower may ride at an angle within the magazine housing, the magazine housing itself may be angled or the base of the magazine housing may be angled relative to the front and rear surfaces. The magazine may also be larger at the bottom and taper to a smaller size at the top. A typical magazine spring of the prior art does not effectively utilize the area within the irregular shapes of the magazine housing, especially when the spring is compressed. Magazine springs compress into a generally symmetric vertical stack though the space within which it is compressed may be of an irregular angled shape leaving valuable unused space that could be utilized to contain spring material (as part of the spring). Additional spring material would increase the length and or the force of the spring per coil which ultimately would allow fewer coils. It may also allow a thinner spring material. Fewer coils and thinner material equals shorter compressed height of the spring. When the compressed height of the spring is reduced, there is more room in the magazine for additional ammunition.

Firearms, particularly pistols, are often miniaturized for easier carry and concealment. Typical compact firearm designs often sacrifice bullet capacity to accomplish miniaturization especially in pistols where the bullets are stored in a magazine within the grip. Whether a miniaturized firearm or not, it is preferred that the magazine house as many bullets as possible while maintaining as small a size as possible. There is a need for an improved single magazine spring design that allows for more bullet storage within the same amount of space without sacrificing performance.

SUMMARY OF THE INVENTION

The present invention is directed to a flat firearm magazine spring formed in a shape that compresses to a fraction of the height (fully compressed) of a typical wire spring or prior flat springs, while maintaining appropriate forces. In a novel way, this spring takes advantage of all volume available within the magazine housing when the magazine is full (i.e., fully loaded with bullets) and the spring is fully compressed, as well as when the magazine is empty and the spring is extended. The result is utilization of maximum spring material within the irregularly shaped available space of firearm magazines, which is unlike any prior magazine spring. This design provides a considerably shorter compressed spring without sacrificing the free length or force of the spring which allows for more bullets in the magazine in a simple single spring design.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

GENERAL PARTS DESCRIPTION

Figure 1:
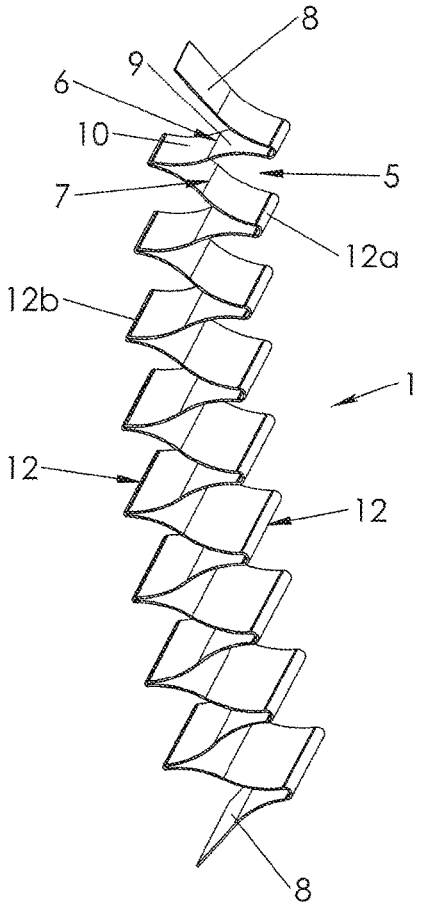
FIG. 1 is a perspective view of the flat spring of the present invention, according to one embodiment, wherein the spring is shown in its uncompressed, relaxed state.

| Reference # | Description |
|---|---|
| 1 | Flat Magazine Spring - Present Invention |
| 2 | Follower |
| 3 | Magazine Housing |
| 4 | Bullet |
| 5 | Coil |
| 5a | Coil Length |
| 6 | Upper Half-Coil |
| 7 | Lower Half-Coil |
| 8 | End Half-Coil |
| 9, 10 | Opposing Arc Shapes |
| 12 | Outer Tip |
| 12a | Larger Radius Outer Tip |
| 12b | Smaller Radius Outer Tip |
| 15 | Vacant Space |
| 16 | Prior Art Wire Spring |
| 17 | Shape Matching Radius |

DETAILED DESCRIPTION OF THE PREFERRED EMBODIMENTS

Referring to the several views of the drawings, the compact flat magazine spring of the present invention is shown according to several embodiments thereof and is generally indicated as 1 throughout the drawings. The spring 1 is formed as a one-piece, unitary body having repeating interior coils 5 each consisting of an upper half-coil 6 and a lower half-coil 7 that are formed together in a general accordion shape. There are two end half-coils 8, one at each the beginning end and the terminating end of the spring 1. Each interior half-coil 6, 7 consists of two opposing arc shapes 9, 10 that are tangent or near tangent to one another. The half-coils 6,7 are attached together at each outer tip 12 with the smallest radius that the chosen material will allow on at least one side. The end half-coils 8 differ from the interior half-coils 6,7 in that they are formed as a single arc shape extending outward from the spring rather than two opposing arc shapes 9,10 thus maximizing the free length of the spring 1. The formed shape of the spring 1 is designed so that, upon compression, equal and opposing forces are created that flatten the curved half-coils 6,7,8. When the spring is fully compressed, every half-coil 6,7,8 of the spring is nearly flat so that the compressed height of the spring stack is as short as possible.

Figure 2:
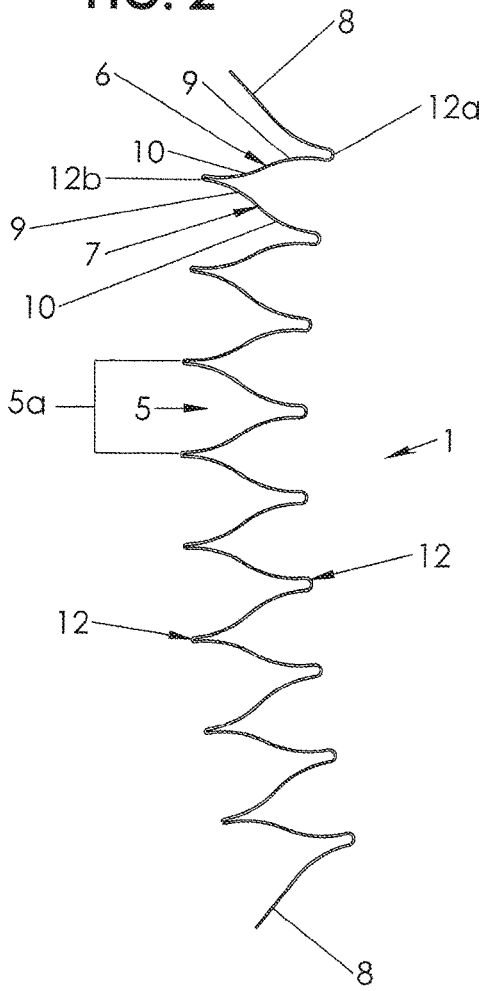
FIG. 2 is a side elevational view of the flat spring in its uncompressed, relaxed state.

It should be noted that when referring to the lengths of the upper and lower half-coils 6,7, the half-coil length is the distance measured between the outer tips on opposite sides of the spring body at the opposite ends of each of the upper and lower half-coils 6,7. This is different than the coil length 5*a* which, as seen in FIGS. 2 and 4A, is the distance between adjacent outer tips on the same side of the spring body when the spring body is in the relaxed state.

Figure 3:
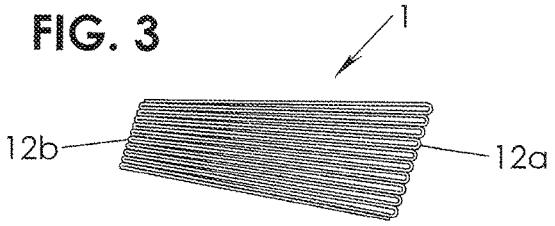
FIG. 3 is a side elevational view of the flat spring in its compressed state.
Figure 4:
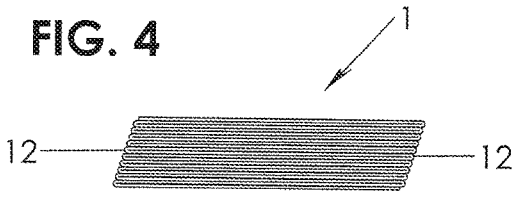
FIG. 4 is a side elevational view of the flat spring of the present invention, according to another embodiment, wherein all of the outer tips of the flat spring are of equal radii and the upper half-coils are longer than the lower half-coils, and wherein the spring is shown in the compressed state to create a slanted spring stack.
Figure 4A:
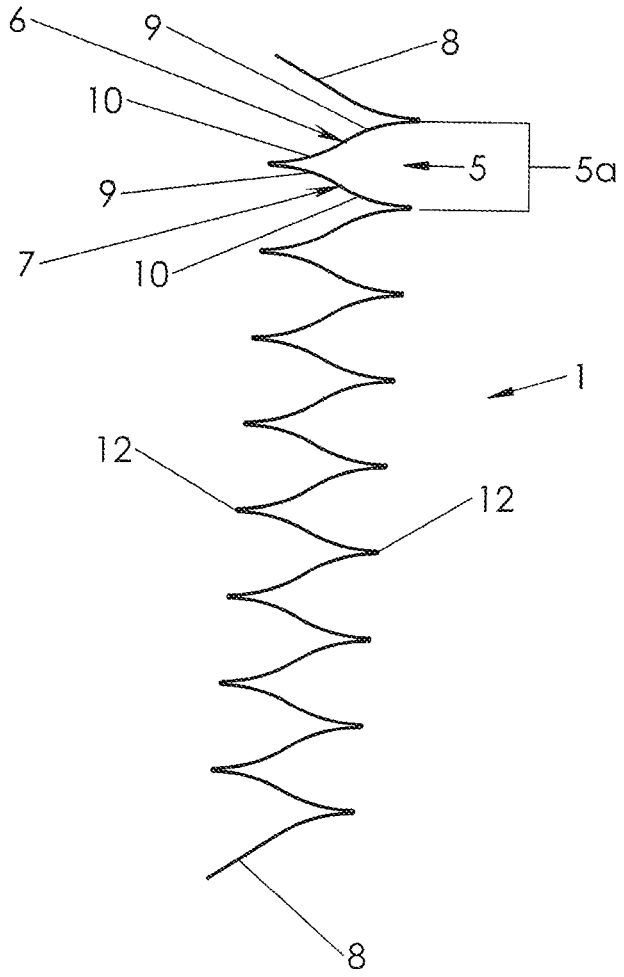
FIG. 4A is a side elevational view of the flat spring having outer tips all of equal radii and wherein the flat spring is shown in the uncompressed, relaxed state.
Figure 5:
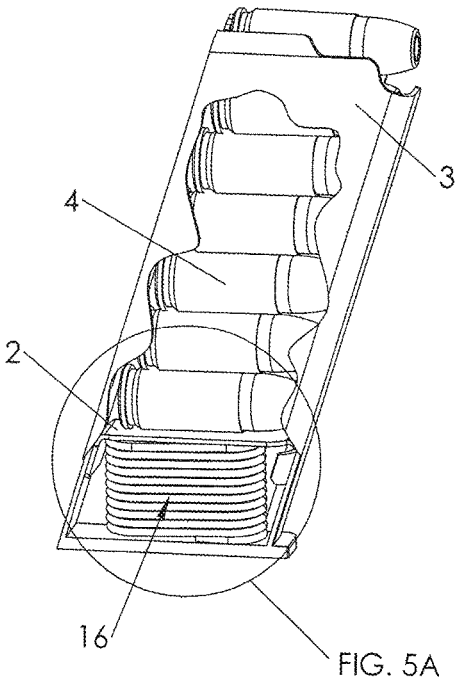
FIG. 5 is a partial cutaway perspective view of an assembled magazine loaded to capacity and showing an example of a wire spring of prior art fully compressed.
Figure 5A:
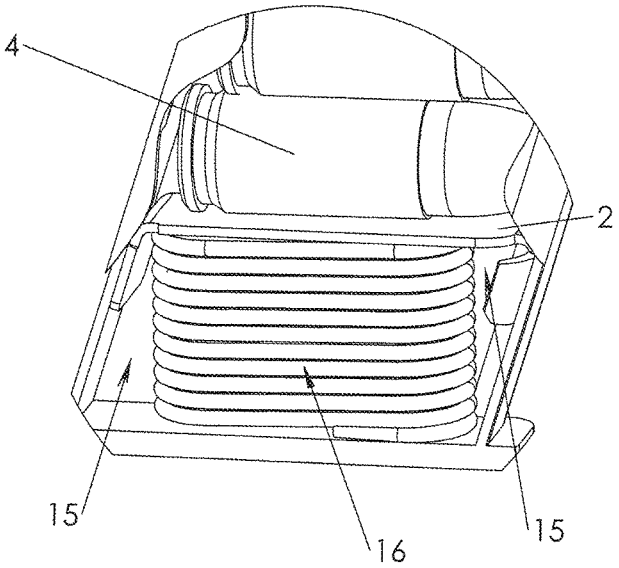
FIG. 5A is magnified view taken from the area indicated as FIG. 5A in FIG. 5 showing the fully compressed prior art wire spring at the bottom portion of the magazine.
Figure 6:
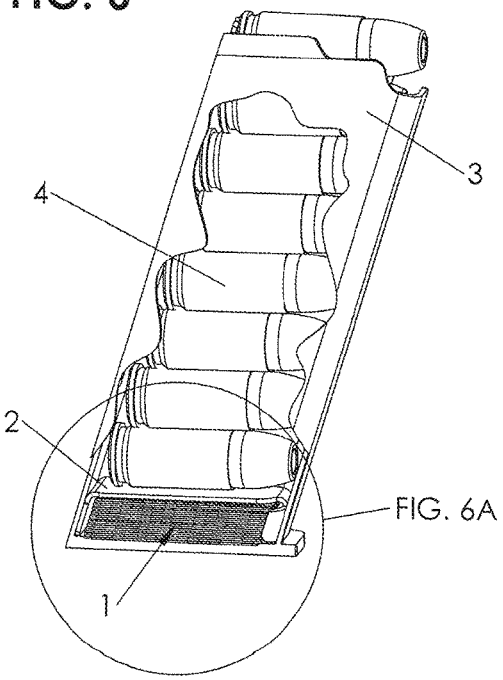
FIG. 6 is a partial cutaway perspective view of an assembled magazine loaded to capacity and showing the flat spring of the present invention, according to the embodiment of FIG. 4, and wherein the spring is fully compressed at the base of the magazine.
Figure 6A:
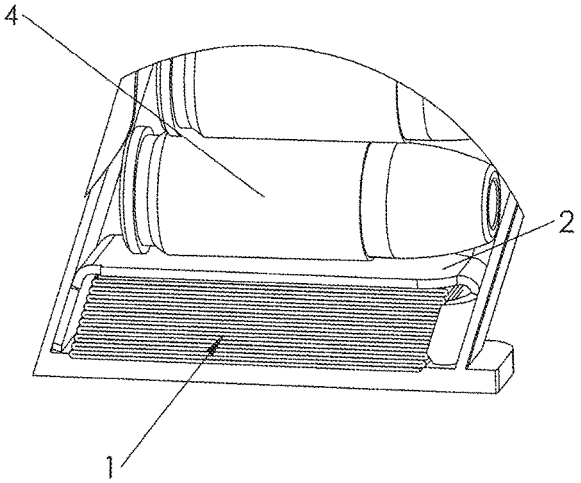
FIG. 6A is a magnified view taken from the area indicated as FIG. 6A in FIG. 6 wherein the flat spring is fully compressed at the base of the fully loaded magazine.

In some embodiments, the upper half-coil 6 is a different overall length than the lower half-coil 7 in each coil 5 which creates an angled stack when the spring is compressed, as seen in FIGS. 3 and 4, for example. The desired forward or rearward angle of the compressed spring stack would determine which half-coil would be longer. The amount of angle of the compressed spring stack would be determined by the difference in length between the upper half-coil 6 and the lower half-coil 7. Refer to FIGS. 4 and 6-6A for an example. This angled stack allows the half-coils 6,7 to be lengthened into areas under the follower 2 that are otherwise vacant spaces 15 in prior art designs (see FIGS. 5 and 5A) when the spring is compressed. Longer half-coils results in greater coil lengths 5*a*. This additional coil length 5*a* contributes to a spring design with fewer coils 5, but equal free (uncompressed) length compared to prior spring designs. Depending on other factors, the gain in coil length 5*a* could also mean reduced material thickness, while maintaining desired spring performance. Fewer coils 5 and less material thickness equals less room necessary for the compressed spring 1 and more room for ammunition 4. For example, FIGS. 5 and 5A illustrate a prior art wire spring in the fully compressed state at the base of the magazine 3, and below the follower 2, which creates vacant space 15. In comparison, FIGS. 6 and 6A illustrate the flat spring 1 of the present invention, in accordance with the embodiment of FIG. 4, wherein the equal radii of the outer tips on opposite sides of the spring body results in a uniform, level spring stack arrangement and the varying lengths of the upper half-coils versus the lower half-coils results in the slanted stack configuration. The result is a significantly lower overall height of the spring stack in the fully compressed state compared to the wire spring of the prior art seen in FIGS. 5-5A, while also filling in the vacant space 15 as a result of the slanted spring stack arrangement. As noted above, the longer half-coils results in greater coil lengths 5*a*, which contributes to a spring design with fewer coils 5, but equal free (uncompressed) length compared to prior art spring designs. As seen in the comparison of the prior art wire spring in FIGS. 5-5A, compared to the flat spring 1 of the present invention shown in FIGS. 6 and 6A, the significantly reduced height of the compressed spring stack of the spring 1 in FIGS. 6 and 6A allows for an additional bullet 4 to be loaded into the same size magazine 3. This additional space, allowing for the additional bullet 4, is a result of the design of the flat spring 1 that maximizes the available space while reducing the overall height of the compressed spring stack.

Figure 7:
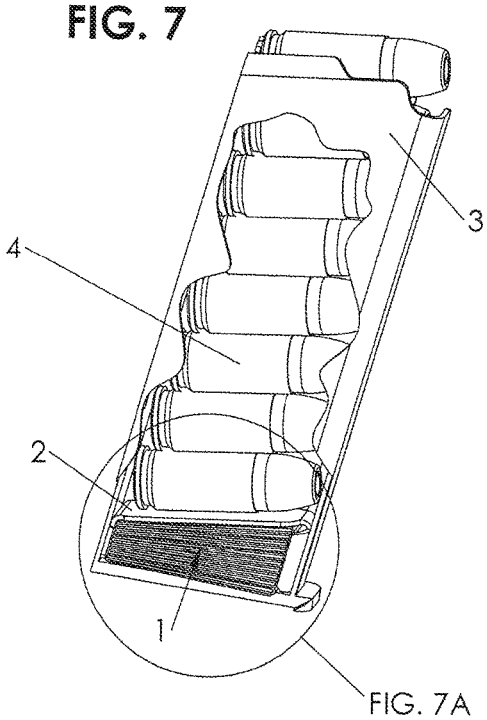
FIG. 7 is a partial cutaway perspective view of an assembled magazine loaded to capacity and showing the flat spring of the present invention, according to another embodiment which may be the same as the embodiment of FIGS. 1-3, wherein the outer tips of the coils on one side of the flat spring have a radius that is larger than the radius of the outer tips on the opposite side of the flat spring, and wherein the flat spring is shown fully compressed at the base of the fully loaded magazine to provide a compressed spring stack that is higher on one side to thereby use all available space at the base of the fully loaded magazine.
Figure 7A:
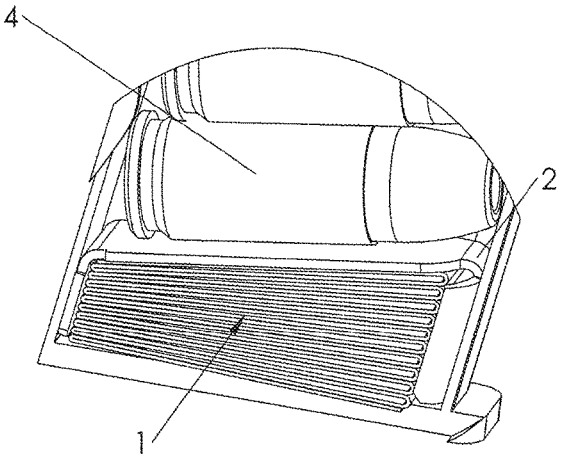
FIG. 7A is a magnified view taken from the area indicated as FIG. 7A in FIG. 7.

Referring to FIGS. 1-3 and 7-7A, some embodiments of the flat spring 1 provide the radii at the outer tips 12 to be minimized down one side of the spring while the radii of the outer tips 12 is larger on the other side of the spring where room in its compressed state permits. More specifically, referring to FIGS. 1-3, the radii of the outer tips 12*a* on the right side of the spring is greater than the radii of the outer tips 12*b* on the left side of the spring 1. By increasing the radii at the outer tips 12*a*, the two half-coils 6,7 that the outer tip 12*a* connects are spread further apart, therefore adding to the coil lengths 5*a*. Also, the larger radius spreads the bending stress at the outer tips 12*a* over a larger material length. This increases the potential angle between half-coils on one side of the spring where the larger radii are used. When the angle between half-coils 6,7 is increased, the coil length 5*a* is also increased. As with the longer half-coils 6,7 described in the prior paragraph, the longer coil lengths 5*a* created by a greater angle between half-coils 6,7 contributes to a spring design with fewer coils 5 but equal or greater free (uncompressed) length compared to prior designs. The larger radius at the outer tips 12*a* is sized so that the compressed spring 1 fills the maximum amount of space under the follower 2 when the magazine is full and the spring is fully compressed, as seen in FIGS. 7 and 7A.

Figure 8:
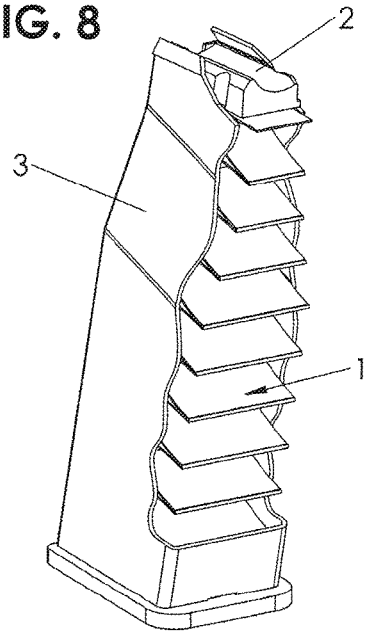
FIG. 8 is a partial cutaway perspective view of an assembled magazine containing the flat spring of the present invention according to yet another embodiment, wherein the half-coils of the flat spring are sized and shaped to conform with the interior shape of the firearm magazine.
Figure 9:
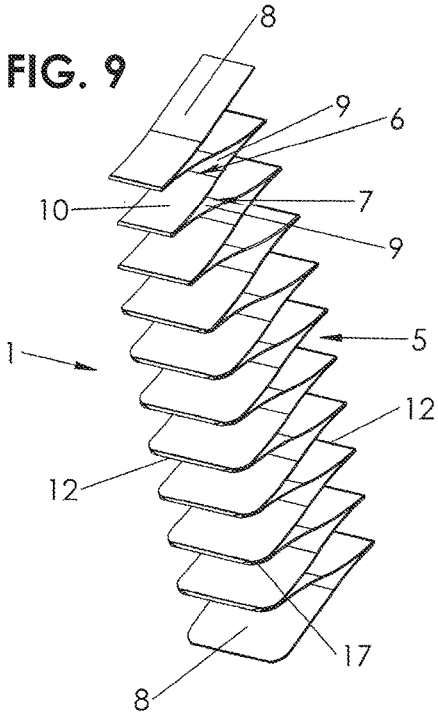
FIG. 9 is a perspective view of the shape matched embodiment of the flat spring.

The shape matched version of the spring 1 is seen in FIG. 1 and FIGS. 8-9. In these embodiments, the spring 1 is shaped so that the uncompressed spring in an empty magazine fits within the shape of the magazine housing 3. In magazines that taper from large at the bottom to small at the top, as is common in many double stack pistol applications, the flat spring 1 would also taper to match. The corners at each end of the outer tips 12 may contain a shape matching radius 17 if necessary to match the interior shape of the magazine housing 3. This shape matching feature maximizes the spring material width within the magazine housing 3. By increasing the spring width (i.e., the widths of the half-coils 6,7 and 8) the spring material thickness can be reduced without sacrificing spring performance. Reduced spring material thickness contributes to minimizing the compressed height of the spring 1.

Increasing and staggering the half-coil 6,7 lengths to create an angled stack, adjusting outer tip 12 radii to maximize the distance and angle between half-coils 6,7 and shape matching the half-coils 6,7 and 8 of the uncompressed spring (FIGS. 1, 8 and 9) within the magazine housing 3 are design features that contribute to a flat magazine spring design that uses all available space within a firearm magazine to effectively reduce the number of coils 5 and material thickness so that the compressed spring height is at its absolute minimum, thereby allowing for maximum space for ammunition.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A flat spring for firearm magazines comprising:

a one-piece unitary spring body having first and second opposite end half-coils at opposite ends of the unitary spring body and a plurality of interior coils in a repeating arrangement between the first and second end half-coils, and the unitary spring body formed in an accordion configuration;

each of the plurality of interior coils including an upper half-coil and a lower half-coil;

a plurality of first outer tips at a junction of the upper half-coil and the lower half-coil of each of the plurality of interior coils;

a plurality of second outer tips at a junction of the upper half-coil and the lower half-coil of adjacent ones of the plurality of interior coils and also at a junction of the upper half-coil of an uppermost one of the plurality of interior coils and the first end half-coil and at a junction of the lower half-coil of a lowermost one of the plurality of interior coils and the second end half-coil;

the plurality of first outer tips are arranged along one side of the unitary spring body and the plurality of second outer tips are arranged along an opposite side of the unitary spring body;

each of the plurality of upper and lower half-coils including a first portion having an arc shape and a second portion having an opposing arc shape, and the combined first and second portions spanning from one of the plurality of first outer tips to one of the plurality of second outer tips to define a length of each of the upper and lower half-coils, and the first and second end half-coils each having a single arc shape extending from one of the plurality of first or second outer tips to a terminal end to define a length of each of the first and second end half-coils;

the first and second end half-coils and the upper and lower half-coils each having a width measured between opposite side edges;

the unitary spring body being operable between a relaxed state defining a free spring length wherein the plurality of first outer tips are spaced apart from one another and the plurality of second outer tips are spaced apart from one another, and a fully compressed state defining a minimum height of the unitary spring body wherein the first end half-coil, the second end half-coil and the upper and lower half-coils of each of the plurality of interior coils are all collapsed in a stacked arrangement and the arc shapes of the first and second portions of the upper and lower half-coils and the arc shapes of the first and second end half-coils are all flattened to generate spring energy that is urging the unitary spring body back to the relaxed state; and each of the upper half-coils having a first length and each of the lower half-coils having a second length that is different from the first length of each of the upper half-coils, so that when the spring is in the fully compressed state, the plurality of first outer tips and the plurality of second outer tips are arranged at a slanted angle relative to the first and second end half-coils at a top and bottom of the stacked arrangement to achieve a slanted compressed spring stacked arrangement.

2. The flat spring as recited in claim 1 wherein each of the plurality of first outer tips have a first radius and each of the plurality of second outer tips have a second radius.

3. The flat spring as recited in claim 2 wherein the first radius of each of the plurality of first outer tips is equal to the second radius of each of the plurality of second outer tips.

4. The flat spring as recited in claim 2 wherein the first radius of each of the plurality of first outer tips is different than the second radius of each of the plurality of second outer tips.

5. The flat spring as recited in claim 1 wherein the width of the first and second end half-coils and the width of each of the upper and lower half-coils is the same.

6. The flat spring as recited in claim 1 wherein the width of the first and second end half-coils and the width of each of the upper and lower half-coils varies to match an interior shape of a firearm magazine.

7. The flat spring as recited in claim 1 wherein the first and second end half-coils and the upper and lower half-coils are each sized and configured to match an interior shape of a firearm magazine.

8. A flat spring for firearm magazines comprising:

a one-piece unitary spring body having first and second opposite end half-coils at opposite ends of the unitary spring body and a plurality of interior coils in a repeating arrangement between the first and second end half-coils, and the unitary spring body formed in an accordion configuration;

each of the plurality of interior coils including an upper half-coil and a lower half-coil;

a plurality of first outer tips at a junction of the upper half-coil and the lower half-coil of each of the plurality of interior coils;

a plurality of second outer tips at a junction of the upper half-coil and the lower half-coil of adjacent ones of the plurality of interior coils and also at a junction of the upper half-coil of an uppermost one of the plurality of interior coils and the first end half-coil and at a junction of the lower half-coil of a lowermost one of the plurality of interior coils and the second end half-coil;

the plurality of first outer tips are arranged along one side of the unitary spring body and the plurality of second outer tips are arranged along an opposite side of the unitary spring body;

each of the plurality of upper and lower half-coils including a first portion having an arc shape and a second portion having an opposing arc shape, and the combined first and second portions spanning from one of the plurality of first outer tips to one of the plurality of second outer tips to define a length of each of the upper and lower half-coils, and the first and second end half-coils each having a single arc shape extending from one of the plurality of first or second outer tips to a terminal end to define a length of each of the first and second end half-coils;

the first and second end half-coils and the upper and lower half-coils each having a width measured between opposite side edges;

the unitary spring body being operable between a relaxed state defining a free spring length wherein the plurality of first outer tips are spaced apart from one another and the plurality of second outer tips are spaced apart from one another, and a fully compressed state defining a minimum height of the unitary spring body wherein the first end half-coil, the second end half-coil and the upper and lower half-coils of each of the plurality of interior coils are all collapsed in a stacked arrangement and the arc shapes of the first and second portions of the upper and lower half-coils and the arc shapes of the first and second end half-coils are all flattened to generate spring energy that is urging the unitary spring body back to the relaxed state; and each of the plurality of first outer tips having a first radius and each of the plurality of second outer tips having a second radius, the first radius of each of the plurality of first outer tips is different than the second radius of each of the plurality of second outer tips so that when the unitary spring body is in the fully compressed state the stacked arrangement is higher on one side compared to an opposite side of the stacked arrangement, and wherein the one side is defined by the arrangement of either the plurality of first outer tips or the plurality of second outer tips and the opposite side is defined by the arrangement of either the plurality of first outer tips or the plurality of second outer tips.

9. The flat spring as recited in claim 8 wherein the length of each of the upper half-coils and the length of each of the lower half-coils is the same, so that when the spring is in the fully compressed state, the plurality of first outer tips are vertically aligned and perpendicular to the first and second end half-coils at a top and bottom of the stacked arrangement, and the plurality of second outer tips are vertically aligned and perpendicular to the first and second end half-coils at the top and the bottom of the stacked arrangement.

10. The flat spring as recited in claim 8 wherein each of the upper half-coils have a first length and each of the lower half-coils have a second length that is different from the first length of each of the upper half-coils, so that when the spring is in the fully compressed state, the plurality of first outer tips and the plurality of second outer tips are arranged at a slanted angle relative to the first and second end half-coils at a top and bottom of the stacked arrangement to achieve a slanted compressed spring stacked arrangement.

11. The flat spring as recited in claim 8 wherein the width of the first and second end half-coils and the width of each of the upper and lower half-coils is the same.

12. The flat spring as recited in claim 8 wherein the width of the first and second end half-coils and the width of each of the upper and lower half-coils varies to match an interior shape of a firearm magazine.

13. The flat spring as recited in claim 8 wherein the first and second end half-coils and the upper and lower half-coils are each sized and configured to match an interior shape of a firearm magazine.

14. A flat spring for firearm magazines comprising:

a one-piece unitary spring body having first and second opposite end half-coils at opposite ends of the unitary spring body and a plurality of interior coils in a repeating arrangement between the first and second end half-coils, and the unitary spring body formed in an accordion configuration;

each of the plurality of interior coils including an upper half-coil and a lower half-coil;

a plurality of first outer tips at a junction of the upper half-coil and the lower half-coil of each of the plurality of interior coils;

a plurality of second outer tips at a junction of the upper half-coil and the lower half-coil of adjacent ones of the plurality of interior coils and also at a junction of the upper half-coil of an uppermost one of the plurality of interior coils and the first end half-coil and at a junction of the lower half-coil of a lowermost one of the plurality of interior coils and the second end half-coil;

the plurality of first outer tips are arranged along one side of the unitary spring body and the plurality of second outer tips are arranged along an opposite side of the unitary spring body;

each of the plurality of upper and lower half-coils including a first portion having an arc shape and a second portion having an opposing arc shape, and the combined first and second portions spanning from one of the plurality of first outer tips to one of the plurality of second outer tips to define a length of each of the upper and lower half-coils, and the first and second end half-coils each having a single arc shape extending from one of the plurality of first or second outer tips to a terminal end to define a length of each of the first and second end half-coils;

the first and second end half-coils and the upper and lower half-coils each having a width measured between opposite side edges;

the unitary spring body being operable between a relaxed state defining a free spring length wherein the plurality of first outer tips are spaced apart from one another and the plurality of second outer tips are spaced apart from one another, and a fully compressed state defining a minimum height of the unitary spring body wherein the first end half-coil, the second end half-coil and the upper and lower half-coils of each of the plurality of interior coils are all collapsed in a stacked arrangement and the arc shapes of the first and second portions of the upper and lower half-coils and the arc shapes of the first and second end half-coils are all flattened to generate spring energy that is urging the unitary spring body back to the relaxed state; and the width of the first and second opposite end half-coils and the width of each of the upper and lower half-coils varies to match an interior shape of a firearm magazine.

15. The flat spring as recited in claim 14 wherein the length of each of the upper half-coils and the length of each of the lower half-coils is the same, so that when the spring is in the fully compressed state, the plurality of first outer tips are vertically aligned and perpendicular to the first and second end half-coils at a top and bottom of the stacked arrangement, and the plurality of second outer tips are vertically aligned and perpendicular to the first and second end half-coils at the top and the bottom of the stacked arrangement.

16. The flat spring as recited in claim 14 wherein each of the upper half-coils have a first length and each of the lower half-coils have a second length that is different from the first length of each of the upper half-coils, so that when the spring is in the fully compressed state, the plurality of first outer tips and the plurality of second outer tips are arranged at a slanted angle relative to the first and second end half-coils at a top and bottom of the stacked arrangement to achieve a slanted compressed spring stacked arrangement.

17. The flat spring as recited in claim 14 wherein each of the plurality of first outer tips have a first radius and each of the plurality of second outer tips have a second radius.

18. The flat spring as recited in claim 17 wherein the first radius of each of the plurality of first outer tips is equal to the second radius of each of the plurality of second outer tips.

19. The flat spring as recited in claim 17 wherein the first radius of each of the plurality of first outer tips is different than the second radius of each of the plurality of second outer tips.

* * * * *